US005994989A

United States Patent [19]

Rowe et al.

[11] Patent Number: 5,994,989

[45] Date of Patent: Nov. 30, 1999

[54] ELECTRICAL SHORTING BLOCK WITH CAPTURED SPRING-BIASED SHORTING CONNECTORS

[75] Inventors: Neal Edward Rowe, Asheville, N.C.; Robert Lewis Newton, Jr., Elgin, Ill.

[73] Assignee: Eaton Corporation, Cleveland, Ohio

[21] Appl. No.: 09/204,960

[22] Filed: Dec. 3, 1998

[51] Int. Cl.[6] ..... H01H 9/02

[52] U.S. Cl. ..... 335/202; 335/8; 335/18; 439/709; 439/813

[58] Field of Search ..... 335/202, 8, 6, 335/10, 18; 439/709, 813, 814, 713, 714

[56] References Cited

U.S. PATENT DOCUMENTS

| | | | |
|---|---|---|---|
| 3,860,314 | 1/1975 | Vandiveer et al. | 439/54 |
| 4,269,471 | 5/1981 | Woertz | 439/94 |
| 4,511,204 | 4/1985 | Glenn | 439/625 |
| 4,519,668 | 5/1985 | Fujita et al. | 439/775 |

OTHER PUBLICATIONS

Cooper Industries, *Magnum Electrical Products*, 1995, pp. 1, 2, 10, & 14 USA. (No Month).

*Primary Examiner*—Lincoln Donovan
*Assistant Examiner*—Tuyen Nguyen
*Attorney, Agent, or Firm*—Martin J. Moran

[57] ABSTRACT

An electrical shorting block has a molded body with a plurality of side-by-side recesses in which terminal members having first, tapped apertures are secured. A shorting bar supported in the molded body extends across but is spaced from the terminal numbers and has second apertures aligned with the first apertures. For the hot side terminal members, shorting connectors slidable through but captured by the apertures in the shorting bar have threaded ends which can be selectively threaded into the tapped first apertures of those terminal members. Helical compression springs bias the captured shorting connectors away from the terminal members when not used to short the terminal. Common terminal members are connected to the shorting bar by shorting screws which remain threaded into the first apertures. The terminal members preferably have both screw terminations and male fast-on terminations.

22 Claims, 5 Drawing Sheets

ELECTRICAL SHORTING BLOCK WITH CAPTURED SPRING-BIASED SHORTING CONNECTORS

BACKGROUND OF THE INVENTION

1. Field of the Invention

This invention relates to electrical terminations and particularly to shorting blocks for providing a short in an electrical circuit, such as, for instance, in the circuits for current transformers and especially current transformers used in electric power distribution systems.

2. Background Information

There are applications where it is necessary to provide a short in an electrical circuit. One such application is in connection with current transformers in electric power distribution systems. If the load is removed from a current transformer which remains coupled to an active power circuit, the voltage in the secondary winding of the transformer will soar and can result in damage. Accordingly, shorting blocks are used to provide a path for the current in the secondary winding to circulate.

A known type of shorting block has an elongated molded body with a number of flat terminal strips extending transversely with insulating partitions between them. The short, flat terminal strips have screw terminations at each end. A shorting bar extends longitudinally along the molded body across all the terminal strips and is secured as by screws on top of the partitions. Shorting screws are passed through apertures in the shorting block to engage threaded apertures in the terminal strips for those terminals which are to be shorted. When not in use, the shorting screws have to be stored elsewhere. In one version of this known shorting block, a limited number of the shorting screws not being used are stored in blind apertures molded into flanges on the ends of the housing. These flanges also have mounting holes for securing the terminal block to a support. Thus, the termination and the shorting screws all extend 180° from the mounting surface.

There is a need for improved electrical shorting blocks.

There is a special need for improved electrical shorting blocks in which the shorting connectors are not likely to be misplaced when not in use. There is an additional need for such an improved electrical shorting block in which the unused shorting connectors are positively restrained from creating an inadvertent short circuit.

SUMMARY OF THE INVENTION

These needs and others are satisfied by the invention which is directed to an electrical shorting block which includes a molded, electrically insulative body with a plurality of side-by-side recesses, and a terminal member in each recess having a first aperture. A shorting bar is supported in the molded body extending across and spaced from the terminal members. This shorting bar has second apertures each aligned with a first aperture in one of the terminal members. Shorting connectors extend through one of the first and second apertures for engagement with the other. Biasing means bias certain of the shorting connectors out of such engagement. Preferably, the certain shorting connectors are slidable through but captured by the apertures in the shorting bar and are extendable for selected engagement with the first apertures in the terminal members.

Preferably, the certain shorting connectors are shorting screws having an elongated shaft with a head at one end and a threaded section only adjacent a second end. The spring is a helical compression spring between the head and the shorting bar which biases the threaded section against the shorting bar. The apertures in the shorting bar for these certain shorting screws is also threaded to form a stop. The shorting block of the invention provides a convenient means of stowing the shorting screws used to selectively short certain of the terminations while also providing a clear visual indication as to which of the terminations are shorted. Additional details of the novel shorting block are specified in the appended claims.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention is directed to a shorting block particularly suitable as a secondary termination shorting block for electric power distribution systems; however, it will be understood by those skilled in the art that the terminal block has other additional applications.

Figure 1:
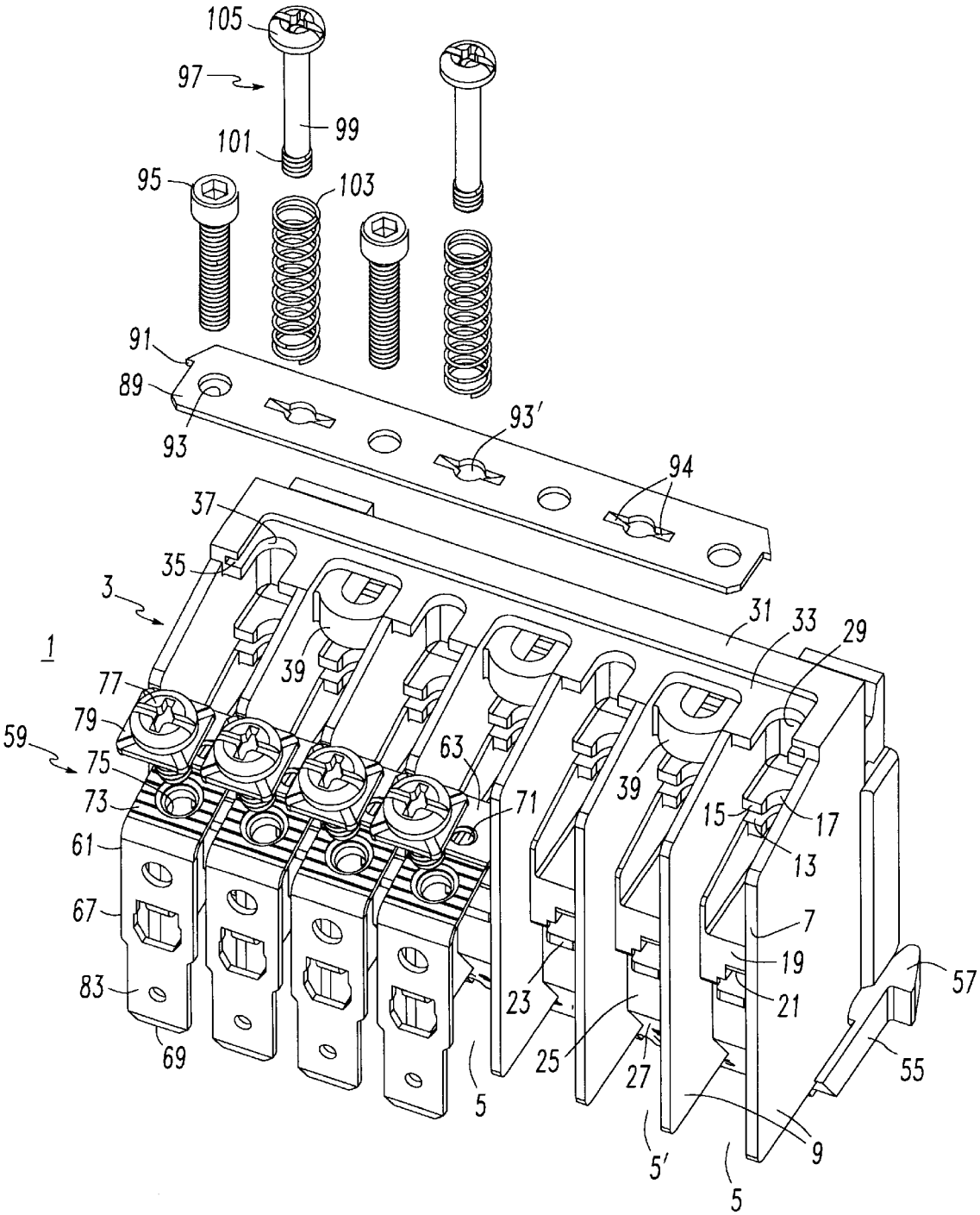
FIG. 1 is an exploded isometric view of a terminal block in accordance with the invention with some parts eliminated for clarity.
Figure 2:
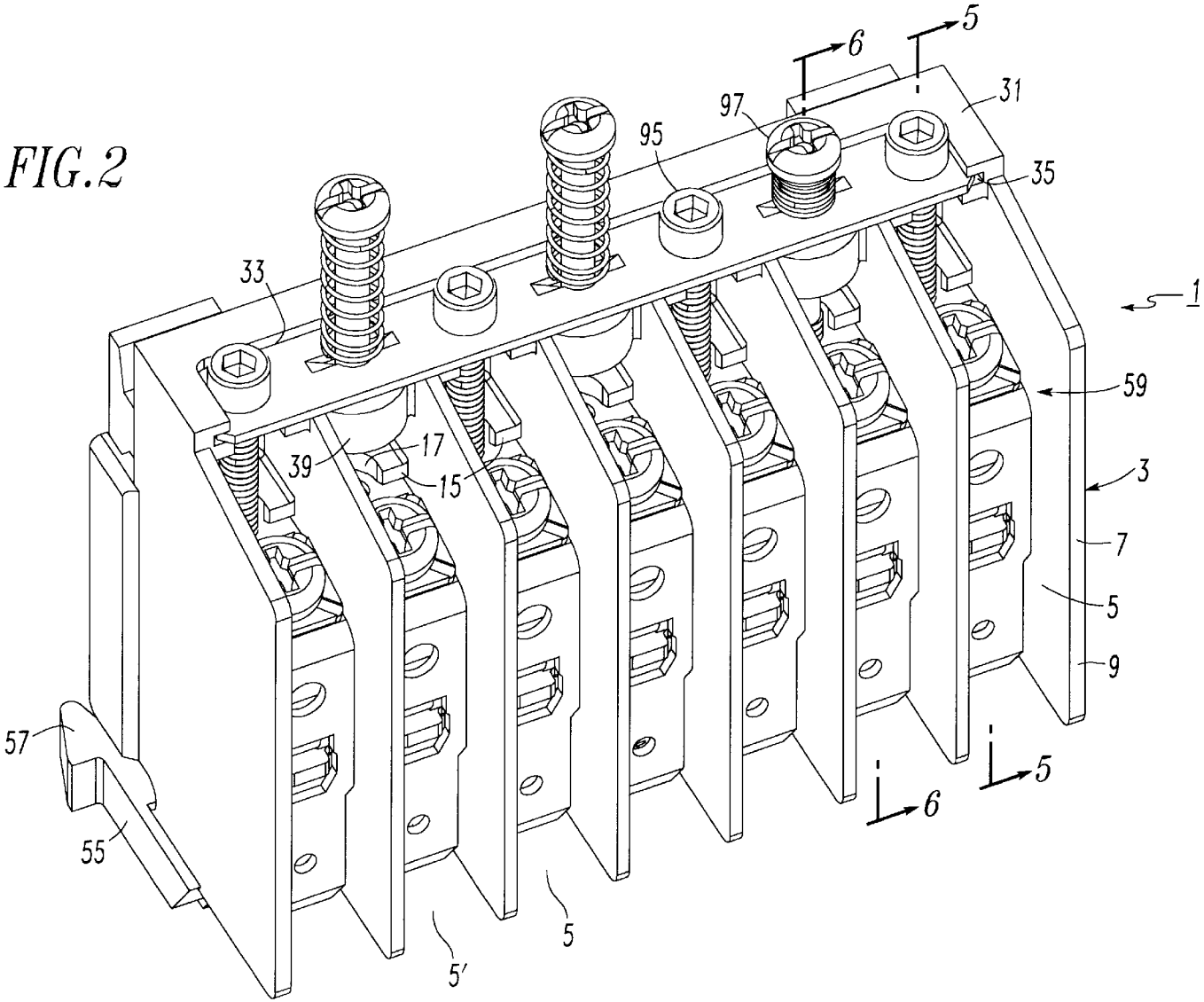
FIG. 2 is an isometric view of an assembled terminal block in accordance with the invention.
Figure 6:
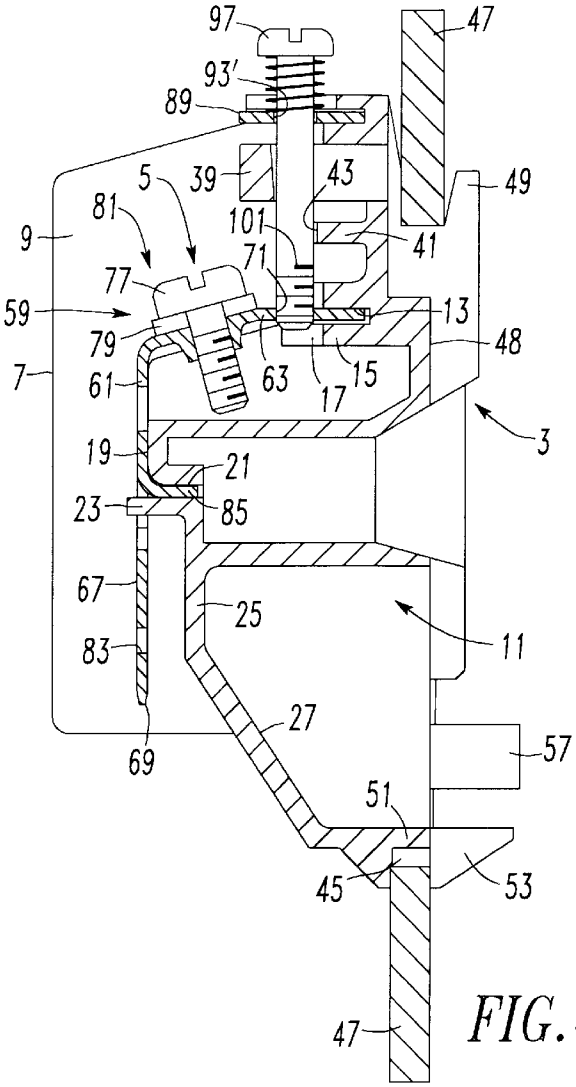
FIG. 6 is a cross sectional view taken along the line 6—6 in FIG. 2.
Figure 5:
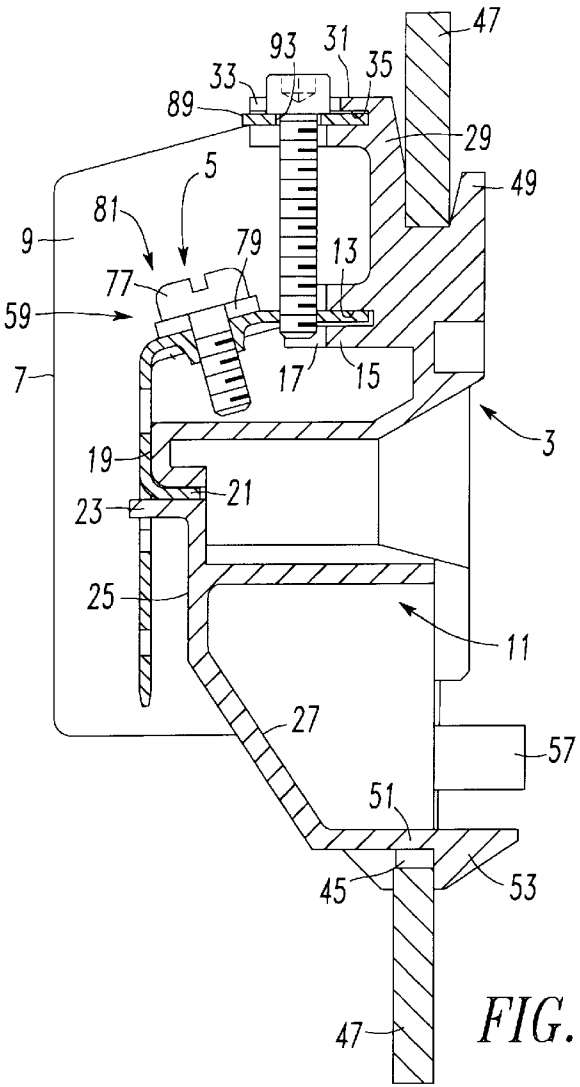
FIG. 5 is a vertical sectional view taken along the line 5—5 in FIG. 2.

Referring particularly to FIGS. 1 and 2, the shorting block 1 of the invention has a molded body 3 made of an electrically insulative material. The molded body 3 has side-by-side elongated recesses 5 formed in a front face 7 by integral partitions 9. As best seen in FIGS. 5 and 6, the molded body 3 has thin walled sections 11 between the partitions 9 which form the recesses 5. First slots 13 extending transversely across the recesses 5 are formed in forwardly extending projections 15 of the thin walled sections as best seen in FIG. 1, half cylindrical grooves 17 extend through the projections 15 perpendicular to the slots 13.

The thin walled sections 11 of the molded body 3 also form an outwardly facing shoulder 19 in each recess. Second slots 21 are formed in each of the shoulders 19. A forwardly projecting tab 23 is molded below each of the second slots 21. The thin walled sections 11 of the body 3 also include a vertical wall section 25 below and recessed inward from the shoulder 19. Below this wall section 25 is a downwardly and rearwardly extending wall section 27.

The thin walled sections 11 also include a back wall 29 extending upward beyond the projections 15 and terminates in a flange 31 which projects forwardly and extends across all of the recesses 5. A recess 33 extends along the top of this flange 31 and leads to an undercut groove 35 which extends around the ends of the recess. In every other recess 5, a U-shaped slot 37 extends through the flange 31. In the other recesses 5 an arcuate shaped guide 39 is molded below the flange 31. These recesses have an additional guide flange 41 with an arcuate cut-out 43 as seen in FIG. 6.

Figure 3:
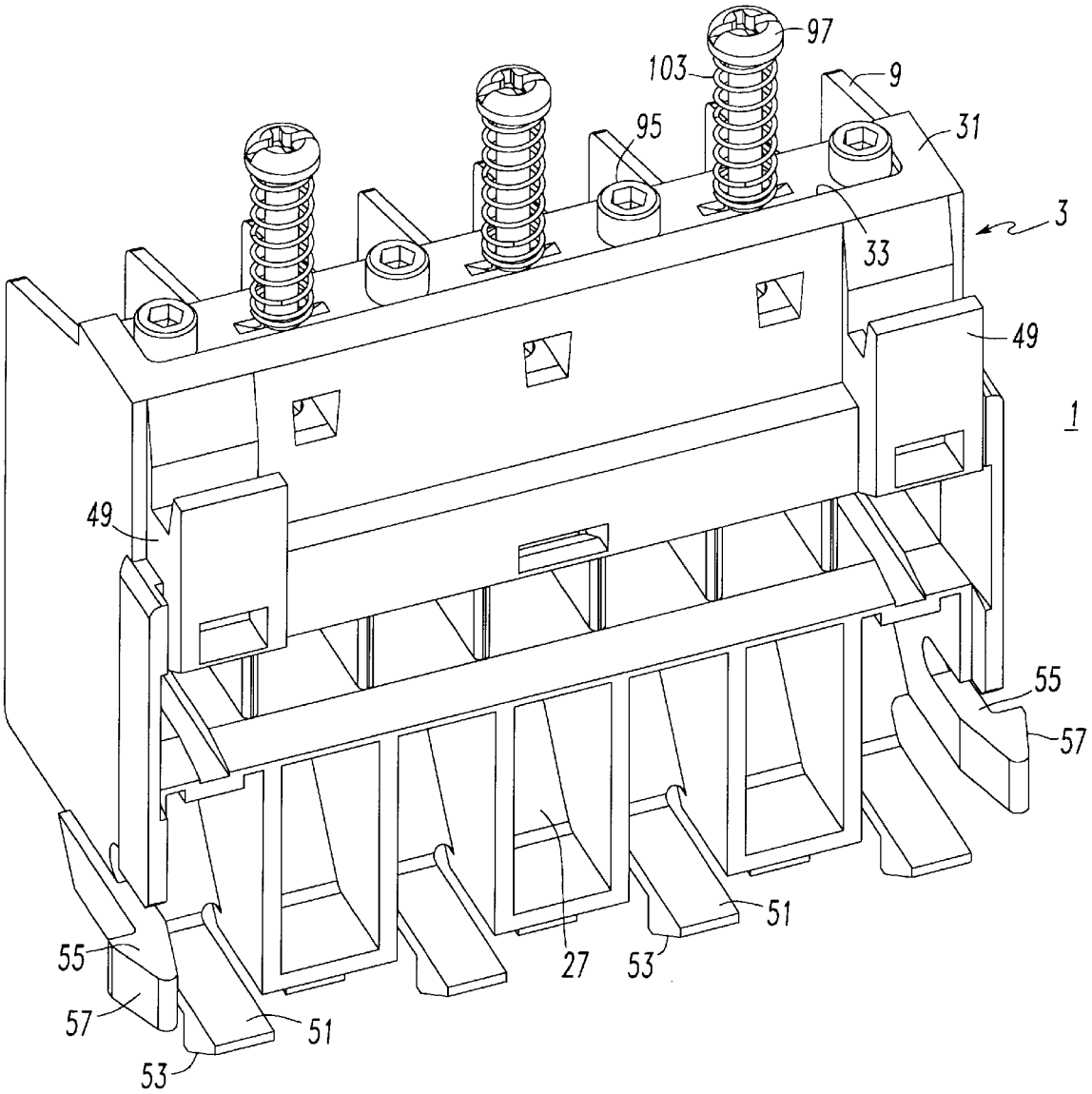
FIG. 3 is a rear isometric view of the terminal block.

The molded body 3 of the mounting block 1 is configured for mounting in a mounting opening 45 in a mounting panel 47 as shown in FIGS. 5 and 6. The rear mounting face 48 of the molded body 3 has at each end a pair of fixed upwardly directed mounting tabs 49 as seen in FIGS. 3, 5 and 6 spaced from the back wall 29. In addition, flexible cantilevered catches 51 with chamfered hooks 53 at their ends are integrally formed along the bottom of the wall 27. Two additional flexible cantilevered catches 55 with chamfered hooks 57 on their ends project laterally outward from the ends of the molded body. The molded body 3 is mounted in the mounting opening 45 by inserting the fixed mounting tabs 49 through the mounting opening 45 to engage the mounting panel 47 and then rotating the bottom of the molded housing inward toward the mounting panel so that the cantilevered catches 51,55 are deflected by the engagement of the chamfered hooks 53,57 on the edge of the opening 45. When the hooks pass through the opening 45, the cantilevered catches 51,55 spring outward to engage the hooks 53,57 and firmly retain the molded body 3 to the mounting panel 47.

Figure 4:
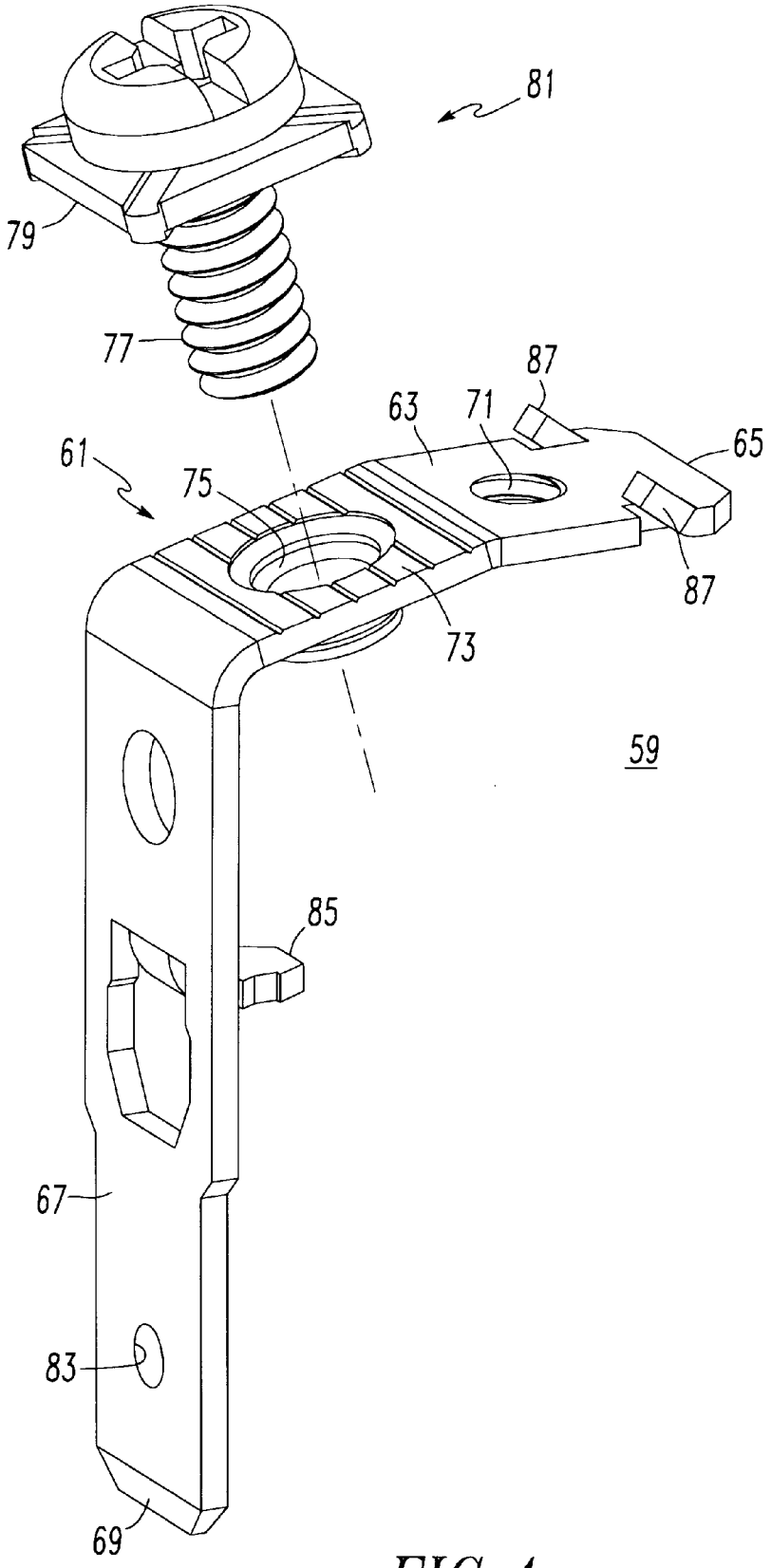
FIG. 4 is an exploded isometric view of a terminal member which forms part of the shorting block of the invention.

The terminal block 1 of the invention further includes a terminal member 59 seated in each of the recesses 5. The terminal members 59 comprise a conductive strip 61, which as best seen in FIG. 4 has a first section 63 extending from one end 65 and a second section 67 extending from a second end 69. The first section 63 of the conductor strip 61 has a first tapped aperture 71. A middle section 73 of the conductive strip 61 has a tapped aperture 75 which receives a terminal screw 77 carrying a clamping plate 79 to form a screw termination 81. The first section 63 of the conductive strip 61 is substantially perpendicular to the second section 67 with the middle section 73 between them forming a small angle with the first section for a purpose to be explained further. The second section 67 of the conductive strip 61 forms adjacent the end 69 a FASTON® male stab type termination 83. A barbed mounting tab 85 is punched out of the second section. In addition, mounting barbs 87 are punched out of the first section 63 of the conductive strip 61. In some applications, all of the terminal members 59 need not have male FASTON® terminations. In such cases, those terminal members 59 only have the first section 63 and middle section 73 and are retained in place in the recesses 5 by the barbs 87.

The terminal members are secured in the recesses 5 and the molded body 3 by inserting the first end 65 of the conductive strip 61 into the first slot 13. The conductive strip 61 is then rotated downward so that the mounting tab, guided by the guide tab 23 enters the second slot 21. As shown in FIGS. 5 and 6, with the second section 67 of the conductive strip 61 seated against the shoulder 19, the male FASTON® termination 83 projects downwardly and is spaced from the vertical wall section 25 to provide clearance for the attachment of a female fast-on termination (not shown).

The shorting block 1 also includes a shorting bar 89 which seats in the recess 33 in the molded housing and has barbs 91 which engage the groove 35. This shorting bar 89 has second apertures 93 which are aligned with the first apertures 71 in the terminal members 59 as can be seen from FIGS. 5 and 6. Every other ones of the second apertures 93' which are aligned with the recesses 5' are punched to form retaining lances 94.

The shorting block 1 further includes shorting connectors in the form of shorting screws 95 and 97. The shorting screws 95 extend through the untapped second apertures 93 and engage the first tapped apertures 71 in the terminal members 59 mounted in the recesses 5. The shorting screws 97 have an elongated shaft 99 having threads 101 only on the free end. The shorting screws 97 are pushed through the retaining lances 94 in the second apertures 93' and engage the first apertures 71 in the terminal members 59. Helical compression springs 103 are seated between the shorting bar and heads 105 on the shorting screws 97. The arcuate guides 39 and guide flanges 41, help to align the shorting screws 97 with the corresponding first aperture 71 in the terminal members 59. The half cylindrical groove 17 in the projections 15 allow clearance for the shorting screws 95 and 97.

As mentioned, the shorting block of the invention is particularly useful in providing terminations for current transformers such as are used in electric power distribution systems. In such an application, terminal members 59 in adjacent recesses 5 and 5' are paired for connection to the secondary windings of a current transformer (CT). For a three-phase system having three current transformers, this would require six terminal members. The common side of the respective CT secondaries are connected through leads with female fast-on terminations (not shown) to the male fast-on termination 83 of the terminal member 59 in the corresponding recess 5. The shorting screws 95 in the recesses 5 engage the first apertures 71 in the corresponding terminal members so that these terminal members are all electrically connected to the shorting bar 89. As there are seven terminal members 59 in the shorting block 1, there is one remaining which is in a recess 5 connected to the shorting bar by a corresponding shorting screw 95. This seventh terminal connector is connected through its male FASTON® termination 83 and a lead with a female FASTON® termination (not shown) to ground. The male fast-on terminations 83 of the other terminal members 59 of each pair of terminal members are connected through leads, again with female FASTON® terminations (not shown), to the hot side of the CT secondary. A load device (not shown) is connected to each pair of terminal members through the screw termination 81, thereby providing a circuit for circulation of CT secondary current.

As has been discussed, it is imperative that a circuit be maintained for circulation of secondary current in a current transformer in which the primary winding remains coupled to a source. If the corresponding load device is removed for service or the circuit is interrupted for some other reason, the shorting screw 97 is screwed into the corresponding first aperture 71 of the hot terminal member 59 to complete the circuit for the secondary winding of that current transformer through the shorting bar 89. However, as long as a circuit is completed between the screw terminations 81 of a pair of terminal members connected to the secondary winding of a current transformer, the corresponding shorting screw 97 is not needed. In that case, it is unscrewed from the terminal member and biased upward away from the corresponding terminal member 59 by the spring 103. The retaining lances 94 in the aperture 93' provides an upward stop for the shorting screw 97. Thus, the shorting screw 97 is captured in an inoperative position but is readily available for re-engagement. This arrangement also provides a quick visual reference as to which pairs of terminal members are shorted. As can be seen from FIG. 2, the shorting block 1 also provides convenient access to the male fast-on terminations and screw terminations from the front face of the terminal block if these terminations are essentially 90° with respect to each other. Clearly, it will be appreciated that terminal blocks with other numbers of terminal members can be realized in accordance with the invention.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and all equivalents thereof.

What is claimed is:

1. An electrical shorting block comprising:

a molded electrically insulative body having a plurality of side-by-side recesses;

a terminal member in each recess each having a first aperture;

a shorting bar supported in said molded body extending across and spaced from said terminal members and having second apertures each aligned with a first aperture in one of said terminal members;

shorting connectors extending through one of said first and second apertures for each terminal member for selected engagement with the other of said first and second apertures; and biasing means biasing certain of said shorting connectors out of engagement with said other of said first and second apertures.

2. The electrical shorting block of claim 1 wherein said terminal members further have a screw termination.

3. The electrical shorting block of claim 2 wherein said terminal members further have a male stab type termination.

4. The electrical terminal block of claim 1 wherein said terminal members have a male stab type termination.

5. The electrical switching block of claim 1 wherein said other of said first and second apertures are threaded and said certain of said shorting connectors each comprises an elongated shaft, a head on one end of said elongated shaft and a threaded section only adjacent a second end of said elongated shaft, said biasing means comprising a helical compression spring between said head and said one of said first and second apertures.

6. The electrical shorting block of claim 5 wherein said threaded section of said elongated shaft of said certain shorting connectors is only long enough to engage one of said first and second apertures at a time.

7. The electrical shorting block of claim 5 wherein said molded electrically insulative body has guides between said shorting bar and said terminal members for guiding said elongated shafts of said shorting connectors to align said threaded sections with threads in said other apertures.

8. The electrical shorting block of claim 5 wherein said one of said first and second apertures comprises said second apertures in said shorting bar and said other of said first and second apertures comprises said first apertures in said terminal members.

9. The electrical shorting block of claim 1 wherein said terminal members are conductive strips having first sections including a first end of said conductive strip, a second section extending from a second end of said conductive strip and a middle section between said first section and said second section, said first apertures being located in said first sections of said conductive strips, and terminations in at least one section of said conductive strip.

10. The electrical shorting block of claim 9 wherein said terminations comprise screw terminations in said middle sections of said conductive strips and male stab type terminations forming said second ends of said second sections of said conductive strips.

11. The electrical shorting block of claim 10 wherein said molded electrically insulative body has first slots in said recesses in which first ends of said conductive strips are retained.

12. The electrical shorting block of claim 11 wherein said second section of said conductive strip extends at an angle of about 90° to said first section.

13. The electrical shorting block of claim 12 wherein said second sections of said conductive strips have tabs extending transversely therefrom and said molded body has second slots in said recesses in which said tabs are retained.

14. The electrical shorting block of claim 13 wherein said molded body has additional guides in said recesses guiding said tabs into said second slots.

15. The electrical shorting block of claim 12 wherein said molded body has a mounting surface about 90° to said first sections of said conductive strips.

16. The electrical shorting block of claim 10 wherein said one apertures are said second apertures in said shorting bar and said other apertures are said first apertures in said conductive strips and are threaded, said shorting connector comprising an elongated shaft, a head at one end of said elongated shaft and a threaded section only adjacent the other end of said elongated shaft, and said biasing means comprises helical compression springs between said heads and said shorting bars.

17. The electrical shorting block of claim 15 wherein said first sections of said conductive strips are planar so that said elongated shafts of said shorting connectors are substantially parallel to screws of said screw terminations.

18. The electrical shorting block of claim 1 adapted for mounting in a mounting opening in a mounting panel wherein said molded electrically insulative body has a mounting surface, integral cantilevered catches adjacent said mounting surface for engaging said mounting opening and integral mounting stops spaced from and facing said catches to engage edges of said mounting opening.

19. The electrical shorting block of claim 18 wherein said molded body has at least two cantilevered catches 90° to each other.

20. The electrical shorting block of claim 18 wherein said mounting surface is substantially parallel to said shorting connectors.

21. An electrical shorting block comprising:

a molded body having a plurality of side-by-side recesses;

a terminal member in each recess each having a first aperture;

a shorting bar supported in said molded body extending across and spaced from said terminal members and having second apertures each aligned with a first aperture in one of said terminal members; and shorting means comprising shorting connectors slidable through but captured by said second apertures in said shorting bar and extendable for selected engagement with said first apertures in said terminal members.

22. The electrical shorting block of claim 21 wherein said shorting means further including springs biasing said shorting connectors away from said terminal members.

* * * * *